US006068499A

United States Patent [19]

Kuriyama et al.

[11] Patent Number: 6,068,499

[45] Date of Patent: May 30, 2000

[54] COAXIAL CONNECTOR AND METHOD OF MANUFACTURING THEREOF

[75] Inventors: Toshitaka Kuriyama; Takekazu Okada, both of Ishikawa-ken, Japan

[73] Assignee: Murata Manufacturing Co., Ltd., Nagaokakyo, Japan

[21] Appl. No.: 08/873,466

[22] Filed: Jun. 12, 1997

[30] Foreign Application Priority Data

Jun. 12, 1996 [JP] Japan ..... 8-151237

[51] Int. Cl.[7] ..... H01R 29/00

[52] U.S. Cl. ..... 439/188; 439/944; 439/63; 439/218; 439/188

[58] Field of Search ..... 439/944, 63, 218, 439/188, 966

[56] References Cited

U.S. PATENT DOCUMENTS

| | | | |
|---|---|---|---|
| 4,185,881 | 1/1980 | Foley et al. | 339/41 |
| 4,657,333 | 4/1987 | Anderson | 439/218 |
| 5,076,797 | 12/1991 | Moulton | 439/944 |
| 5,308,250 | 5/1994 | Walz | 439/63 |
| 5,466,160 | 11/1995 | Ogura | 439/63 |
| 5,601,441 | 2/1997 | Weinstein et al. | 439/944 |
| 5,625,177 | 4/1997 | Yukinori et al. | 439/188 |
| 5,769,652 | 6/1998 | Wider | 439/63 |
| 5,801,330 | 9/1998 | Gagermann et al. | 174/52.1 |

FOREIGN PATENT DOCUMENTS

| | | |
|---|---|---|
| 2733348 | 10/1996 | France . |
| 6-260237 | 9/1994 | Japan . |

*Primary Examiner*—Gary F. Paumen
*Assistant Examiner*—Truc Nguyen
*Attorney, Agent, or Firm*—Burns, Doane, Swecker & Mathis, LLP

[57] ABSTRACT

A coaxial connector ensures positive, stable contact and permits sufficiently reduced size and thickness. The coaxial receptacle (1) is equipped with: a synthetic resin insulating case (2) which has a hexahedron shape; an internal terminal (30) composed of a metallic fixed terminal (4) and a movable terminal (5) made of a flexible metal material, which are provided in a cavity or internal space (3) of the insulating case (2); a rubber elastic member (51) disposed under the movable terminal (5) in the cavity (3) of the insulating case (2); and an external terminal or outer conductor (40) provided to cover an essential section of the insulating case (2). The cavity (3) of the insulating case (2) is a vertical columnar space; and the upper side thereof has an annular opening to form an inlet (7) through which the central contact of a mating coaxial connector is introduced downward.

16 Claims, 7 Drawing Sheets

Fig. 1
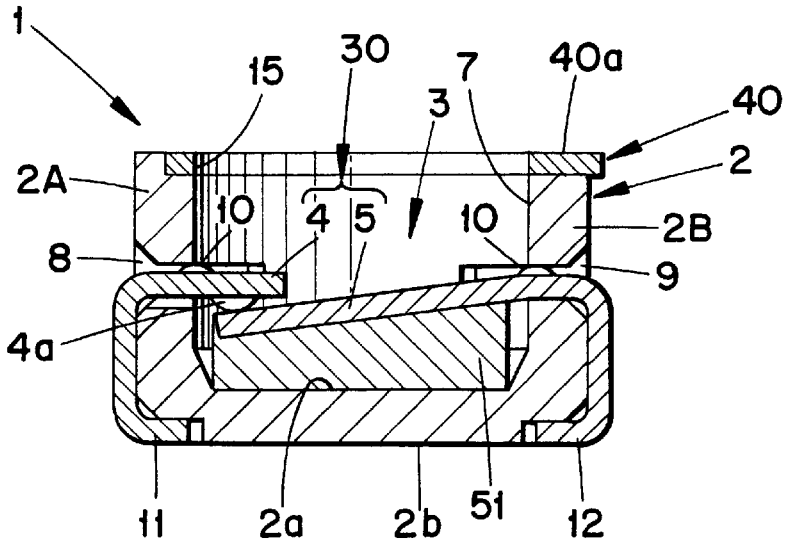
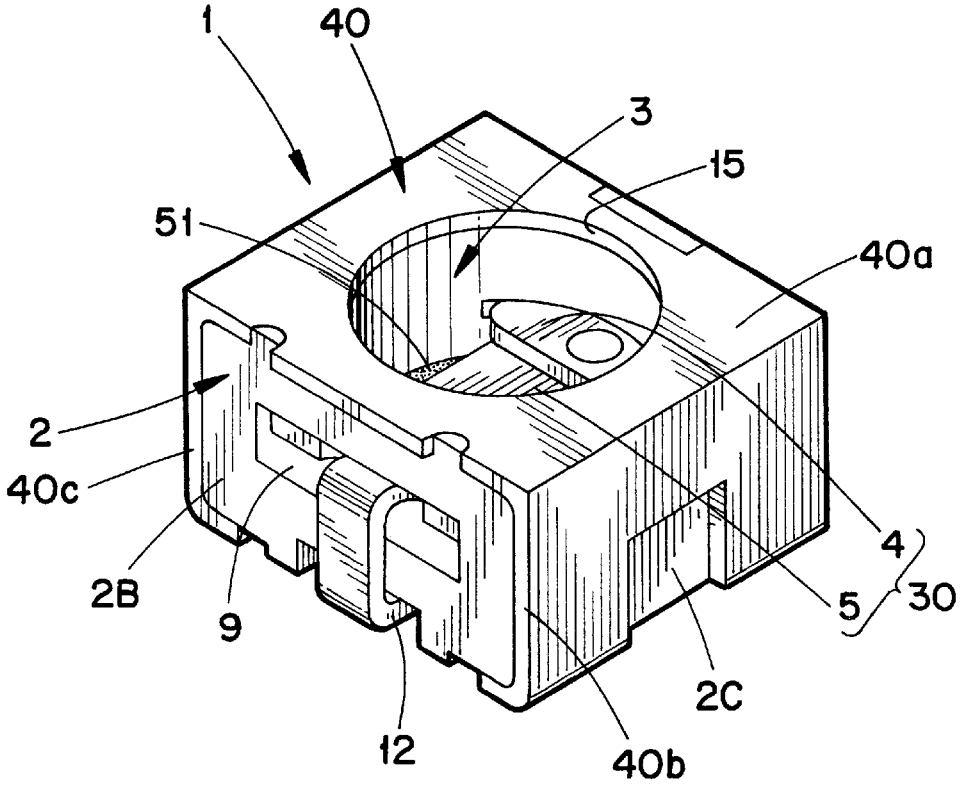
Fig. 2

Fig. 3
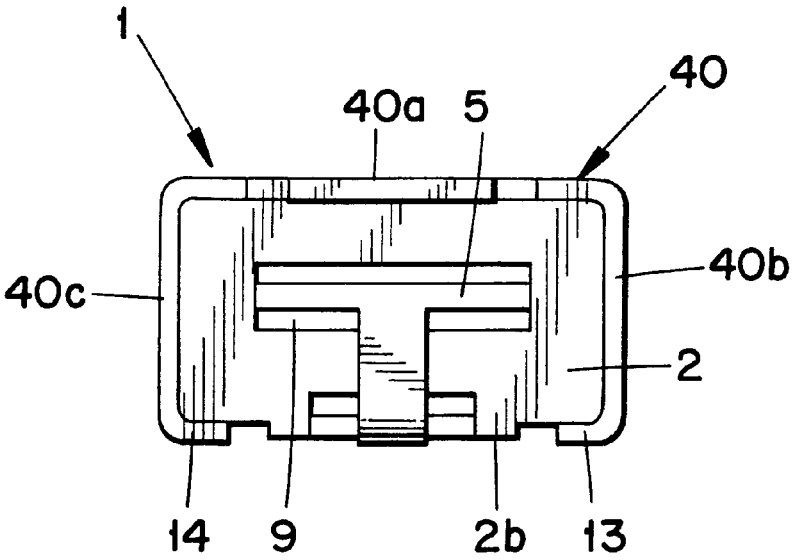
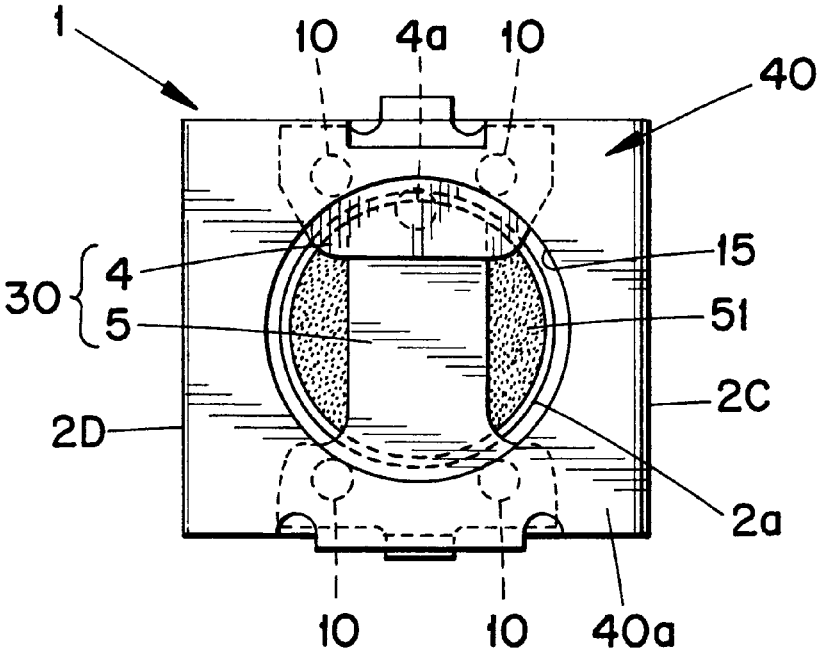
Fig. 4

Fig. 5
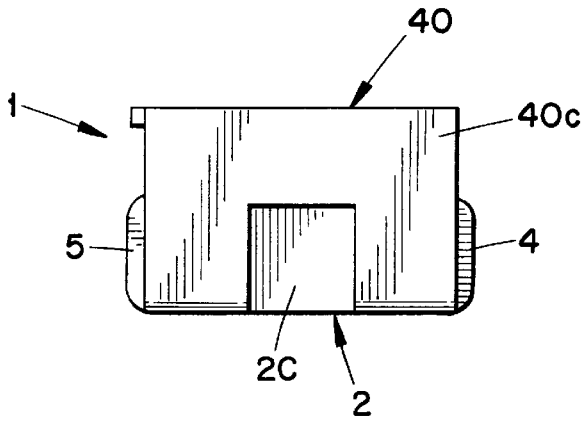
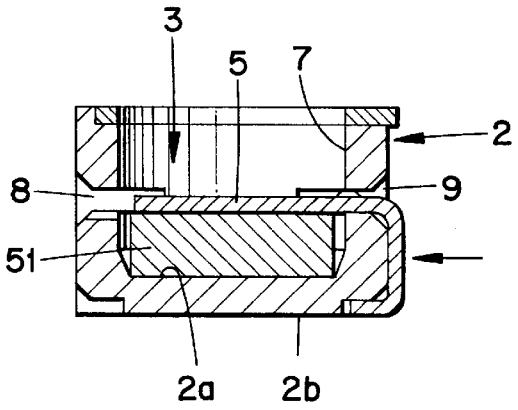
Fig. 6(a)
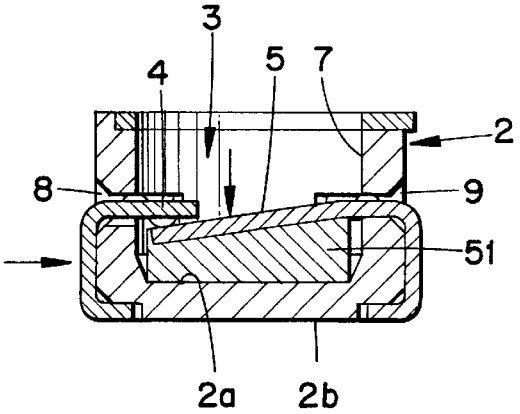
Fig. 6(b)

Fig. 8(a)
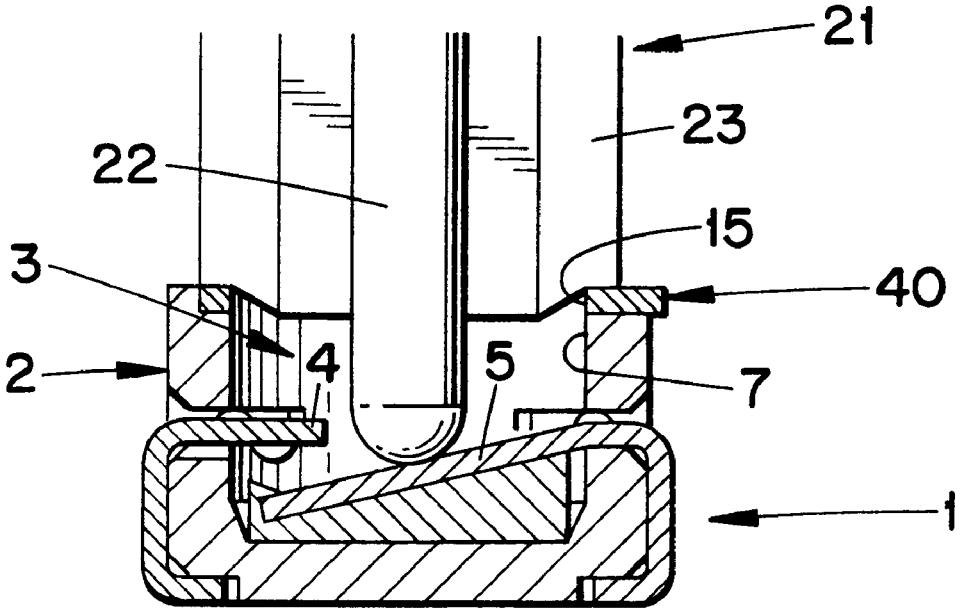
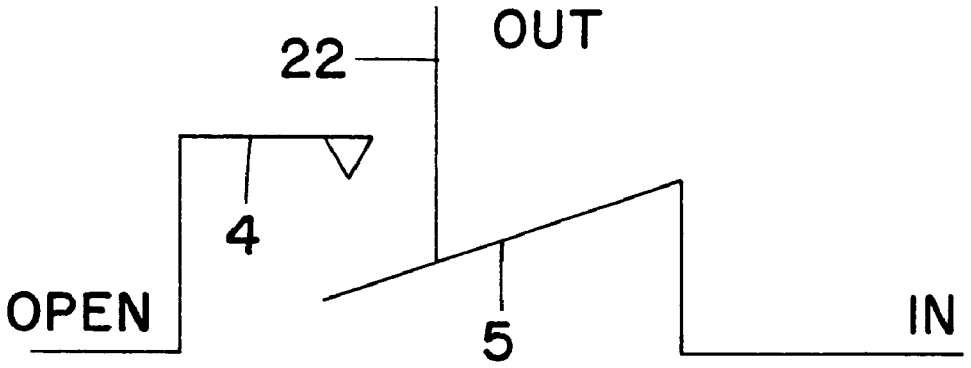
Fig. 8(b)

Fig. 9
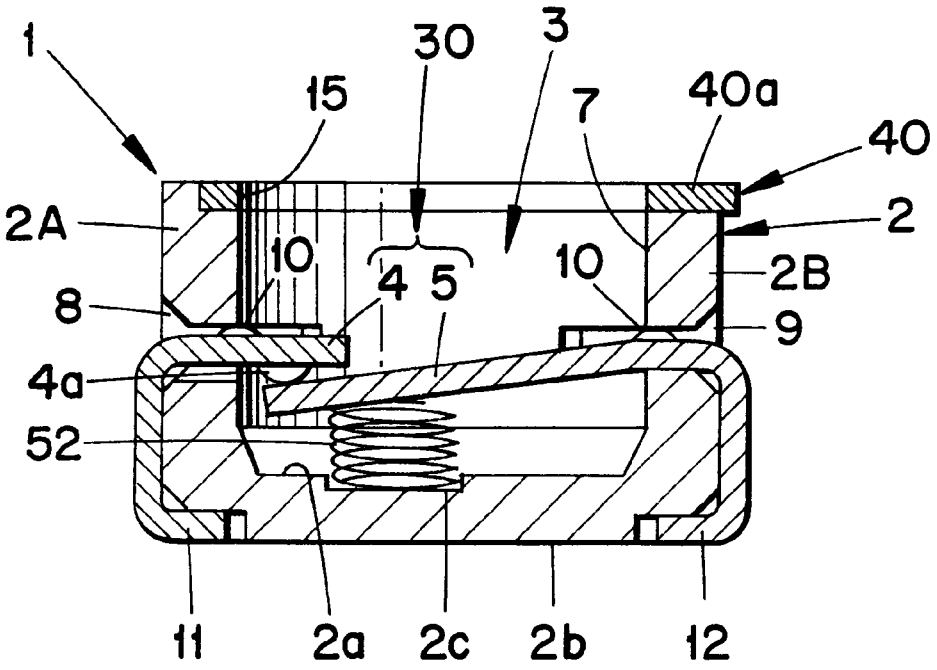
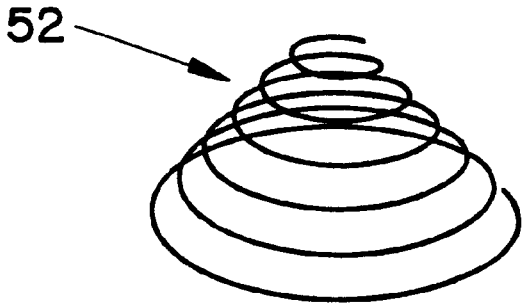
Fig. 10

COAXIAL CONNECTOR AND METHOD OF MANUFACTURING THEREOF

BACKGROUND OF THE INVENTION

1. Field of the Invention

The present invention relates to a coaxial connector used for portable, small electronic equipment or the like and, more particularly, to a coaxial connector which has a movable terminal and a fixed terminal disposed in an insulating case thereof so that the movable terminal and the fixed terminal are connected to or disconnected from each other as a mating coaxial connector is attached thereto or detached therefrom.

2. Description of Related Art

A conventional coaxial connector used for portable communications equipment such as a portable telephone has a construction shown in FIG. 11, for example. A conventional coaxial connector 80 has a fixed terminal 83 and a flexible movable terminal 84 provided in a cavity 82 of a cylindrical insulating case 81. The fixed terminal 83 and the movable terminal 84 have the left ends thereof fixed and they respectively extend rightward along the top and bottom surfaces of the cavity 82 as illustrated in FIGS. 11 and 12. A predetermined interval is provided between the fixed terminal 83 and the movable terminal 84 at their fixed ends. Provided on the outer surface of the insulating case 81 is a cylindrical outer terminal 86 which is disposed in close contact with a cylindrical peripheral surface 85 of the insulating case 81. Also, an additional component 89 is located on the outside of the coaxial connector 80 to make it flat and square.

When no mating coaxial connector is attached to this coaxial connector 80, the urging force of the flexible movable terminal 84 holds itself in contact with the fixed terminal 83. When a mating coaxial connector is attached to the coaxial connector, the movable terminal 84 is pushed up by a central contact 88 of a mating coaxial connector, which has been introduced through an inlet 87 of the coaxial connector 80, and disconnected from the fixed terminal 83, bringing the central contact 88 into contact with the movable terminal 84 as shown in FIG. 12. When the mating coaxial connector is attached, an outer conductor, not shown, of the mating coaxial connector is brought into contact with the external terminal 83 of the coaxial connector 80.

In the foregoing conventional coaxial connector 80, however, the fixed terminal 83 and the movable terminal 84 are so disposed that they are axially aligned and serially positioned with the central contact 88 of the mating coaxial connector, making it impossible to reduce the lateral dimension of the coaxial connector 80 from the sum of the full length of at least the fixed terminal 83 and the full length of the central contact 88. This has posed a problem in that it is difficult to reduce the length as well as thickness of the coaxial connector 80, failing to fulfill the demand for further compacted portable communications equipment and the like.

An attempt to reduce the size of a coaxial connector with the construction illustrated in FIG. 11 would require that the dimension of the inlet 87 through which the central contact 88 is introduced be reduced. This, however, would inevitably make smaller the interval between the fixed and movable terminals 83 and 84 when they are set apart from each other, presenting a problem of insufficient electrical isolation between the fixed and movable terminals 83 and 84 against high-frequency signals.

The difficulty of reducing the thickness is attributable to a considerable distance LY provided to set the fixed terminal 83 and the movable terminal 84 apart vertically; the distance LY must be added to the thickness of the coaxial connector 80, thus preventing the reduced thickness from being achieved. The thickness would be of course reduced by reducing the distance LY; however, doing so would make the fixed terminal 83 and the movable terminal 84 closer, resulting in inadequate electrical isolation between the fixed terminal 83 and the movable terminal 84 against high-frequency signals when they are in a disconnected state as described above. This means that the reduction in the thickness is unlikely to be accomplished by shortening the distance LY in a practical coaxial connector.

SUMMARY OF THE INVENTION

The present invention has been made with a view toward solving the foregoing problems, and it is an object thereof to provide a coaxial connector which ensures reliable, stable contact and permits sufficient reduction in size and thickness compared to the prior art.

To this end, according to the present invention, there is provided a coaxial connector including:

an insulating case having a cavity for accommodating at least a central contact of a mating coaxial connector;

an internal terminal, in the cavity of the insulating case, including a fixed terminal and a movable terminal positioned to be connected to and disconnected from each other, a portion of at least the movable terminal projecting approximately at a right angle to an axis of the central contact of the mating connector accommodated in the cavity;

an elastic member located between a bottom surface in the cavity of the insulating case and the movable terminal such that the elastic member is compressed under pressure applied by the movable terminal when the central contact of the mating connector is accommodated in the cavity of the insulating case; and an external terminal on an outer surface of the insulating case and which comes in contact with the outer conductor of the mating connector when the mating connector is attached to the insulating case;

wherein the movable terminal of the internal terminal is urged in a direction opposite to the introducing direction of the central contact by at least an elastic force of the elastic member such that the fixed terminal comes in contact with the movable terminal and both terminals come into conduction when the central contact of the mating connector is not accommodated in the cavity of the insulating case, and wherein the central contact introduced in the cavity pushes the movable terminal down toward a bottom surface of the cavity to cause the movable terminal to be detached from the fixed terminal when the central contact of the mating connector is accommodated in the cavity of the insulating case.

In a preferred form of the present invention, the projecting portion of at least the movable terminal and a projecting portion of the fixed terminal of the internal terminal are spaced by a predetermined distance from the bottom surface in the cavity such that the projecting portions are approximately opposed to each other.

In another preferred form of the present invention:

the insulating case can have an approximately hexahedron shape;

the lead sections of the movable terminal and the fixed terminal can extend to a rear of the insulating case to provide connection ends nearly flush with the rear surface of the insulating case; and the external terminal can be a plate-like member which is attached to the insulating case and which has an approximately U-shaped longitudinal cross-section comprising a central flat section and two bent sections, a through-hole for receiving a mating coaxial connector into the cavity of the insulating case at the central flat section which covers the top surface of the insulating case, and the bent sections on both sides of the flat section extending to the rear of the insulating case along the outer surface of the side walls of the insulating case to provide connection ends nearly flush with the rear surface of the insulating case.

In still another preferred form of the invention, the insulating case is formed integrally with the external terminal.

In yet another preferred form of the invention, the elastic member is a rubber elastic member, or a spring including a helical coil spring.

Unlike the conventional example as shown in FIG. 11 and FIG. 12, both the movable and fixed terminals are disposed nearly at right angles to the central contact of the mating coaxial connector rather than being disposed in parallel direction thereto. Thus, the total length of the terminals and the central contact does not adversely affect an effort to reduce the dimension of the coaxial connector.

Further, the interval between the movable terminal and the fixed terminal when they are separated is equal to the moving amount of the movable terminal when it is pushed in by the central contact toward the bottom surface. Therefore, even when the whole coaxial connector is made smaller, a sufficient interval can be secured between the two terminals when they are not in contact, by setting an appropriate point reached by the distal end of the central contact.

Moreover, the movable terminal and the fixed terminal are brought and held in contact by the elastic force of the compressed elastic member in addition to the spring force of the movable terminal. This enables an improved force of the contact between the fixed terminal and the movable terminal, permitting reduced contact resistance. The movable terminal does not solely depend on the spring force thereof to accomplish contact with the fixed terminal; therefore, even when the movable terminal is made shorter and the spring force of the movable terminal is decreased, it will be securely brought in contact with the fixed terminal by the elastic force of the elastic member. Thus, the movable terminal can be made even shorter.

In short, owing to the operations described above, in comparison with the conventional example, stable and positive contact between the movable terminal and the fixed terminal can be achieved, and markedly reduced size and thickness can also be accomplished.

The movable terminal and the fixed terminal are disposed to be opposed to each other rather than disposing them vertically as in the conventional example shown in FIG. 11 and FIG. 12. Therefore, it is no longer necessary to install the movable terminal and the fixed terminal vertically with a large interval allowed therebetween, and the disposition of the fixed terminal and the movable terminal does not affect an effort to reduce the thickness of the coaxial connectors. For easier understanding, this aspect will be described with reference to the conventional coaxial connector 80 shown in FIG. 12. In the case of the present invention wherein the movable terminal and the fixed terminal are disposed to face against each other, a fixed terminal 83 will be located at contact point P, i.e. at the same height as that of the movable terminal 84. This enables the thickness to be reduced by distance LZ.

Shaping the insulating case into the nearly hexahedron and attaching the flat section of the external terminal to the top surface of the insulating case enable easier mounting by a chip placer, thus making the present invention even more effective.

Easier surface mounting can be fulfilled by extending both bent sections of the external terminal and the lead sections of the fixed terminal and the movable terminal to the bottom of the insulating case to provide the connection ends nearly flush with the rear surface of the insulating case.

Forming the insulating case integrally with the external terminal makes it possible to fabricate the insulating case while assembling the insulating case and the external terminal at the same time. This permits reduction in manufacturing cost.

BRIEF DESCRIPTION OF THE DRAWINGS

FIG. 1 is a sectional view illustrative of the structure of a coaxial receptacle in accordance with an embodiment of the present invention;

FIG. 2 is a perspective view illustrative of the appearance of the whole coaxial receptacle in accordance with the embodiment of the present invention;

FIG. 3 is a front view illustrative of the appearance of the front of the coaxial receptacle in accordance with the embodiment of the present invention;

FIG. 4 is a top plan view illustrative of the appearance of the top of the coaxial receptacle in accordance with the embodiment of the present invention;

FIG. 5 is a side view illustrative of the appearance of the side of the coaxial receptacle in accordance with the embodiment of the present invention;

FIGS. 6(*a*) and 6(*b*) are explanatory views illustrating how to attach both fixed and movable terminals and an elastic member to an insulating case of the coaxial receptacle in accordance with the embodiment of the present invention;

FIGS. 8(*a*) and 8(*b*) are explanatory views of the operation of the coaxial receptacle in accordance with the embodiment when the mating coaxial plug is attached thereto;

FIG. 9 is a sectional view of a coaxial receptacle in accordance with another embodiment of the present invention;

FIG. 10 is a perspective view of a coil spring of a coaxial receptacle in accordance with still another embodiment of the present invention;

DESCRIPTION OF THE PREFERRED EMBODIMENTS

Figure 7A:
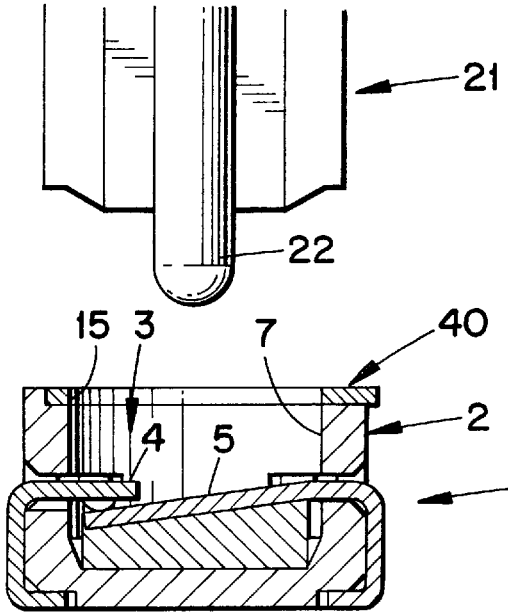
FIGS. 7(*a*) and 7(*b*) are explanatory views of the operation of the coaxial receptacle in accordance with the embodiment when a mating coaxial plug is not attached thereto.

The characteristics of the embodiments of the present invention will be described in further detail. In the following description, surface-mountable coaxial receptacles will be taken as the examples of coaxial connectors.

FIG. 1 is a sectional view illustrative of the structure of a coaxial receptacle; FIG. 2 is a perspective view illustrative of the appearance of the whole coaxial receptacle; FIG. 3 is a front view illustrative of the appearance of the front of the coaxial receptacle; FIG. 4 is a top plan view illustrative of the appearance of the top of the coaxial receptacle; and FIG. 5 is a side view illustrative of the appearance of the side of the coaxial receptacle.

A coaxial receptacle 1 is equipped with: a synthetic resin insulating case 2 which has a hexahedron shape; an internal terminal 30 composed of a metallic fixed terminal 4 and a movable terminal 5 made of a flexible metal material which are provided in a cavity (internal space) 3 of the insulating case 2; an elastic member (e.g., a rubber elastic member) 51 disposed under the movable terminal 5 in the cavity 3 of the insulating case 2; and an external terminal (outer conductor) 40 provided to cover the essential section of the insulating case 2. The cavity 3 of the insulating case 2 is a vertical columnar space; the upper side has an annular opening to form an inlet 7 through which the central contact of a mating coaxial connector is introduced downward as illustrated in the drawings.

The fixed terminal 4 is provided so that it juts out nearly horizontally from the inner surface of the cavity 3 formed in the insulating case 2 at a point above a bottom surface 2*a* by a predetermined distance. The movable terminal 5 is disposed so that it projects nearly horizontally from a point opposed to the point at which the fixed terminal 4 juts out in the cavity 3. As shown in FIG. 1 through FIG. 4, the wide plate-shaped section of the fixed terminal 4 penetrates through a slot 8 in a side wall 2A and juts out into the cavity 3; the distal end of the movable terminal 5 penetrates through a slot 9 in another side wall 2B and projects to the farthest end of the cavity 3 until it touches the bottom surface of the jutting portion of the fixed terminal 4. Small hemispherical projections 10 shown in FIG. 1 are provided on the surfaces of the two terminals 4 and 5 so that the two terminals 4 and 5 are locked onto the inner wall surfaces of the slots 8 and 9, respectively, and serve as stoppers.

The rubber elastic member 51 is composed of a resinous material such as elastomer exhibiting elasticity. It is placed between the bottom surface 2*a* in the cavity 3 of the insulating case 2 and the movable terminal 5. The rubber elastic material 51 is pushed by the movable terminal 5 when a mating coaxial connector is attached, so that the portion thereof abutting against the movable terminal 5 is compressed.

The foregoing movable terminal 5 abuts against the bottom surface of the fixed terminal 4 by the urging force or the spring force from its own flexibility and by the urging force or the elastic force of the rubber elastic member 51 so as to positively bring the fixed terminal 4 and the movable terminal 5 into contact when a coaxial connector is not attached. To be more specific, the fixed terminal 4 has a contact 4*a* on the bottom surface thereof; the contact 4*a* comes in contact with the top surface of the movable terminal 5 to establish conduction between the fixed and movable terminals 4 and 5. Specifically, the spring force of the movable terminal 5 and the elastic force of the elastic member 51 are applied to ensure positive, stable contact for conduction between the movable terminal 5 and the fixed terminal 4.

As shown in FIG. 1, the lead section of the fixed terminal 4 extends along the outer surface of the side wall 2A to the bottom of the insulating case 2 to form a connection end 11 which is approximately flush with a rear surface 2*b* of the insulating case 2. The lead section of the movable terminal 5 extends along the outer surface of the side wall 2B to the bottom of the insulating case 2 to form a connection end 12 which is approximately flush with the rear surface 2*b* of the insulating case 2.

As illustrated in FIG. 1 through FIG. 5, the metallic external terminal 40, which comes in contact with the outer conductor of the mating coaxial connector, is a plate-like member having an approximately U-shaped cross-section as viewed from a longitudinal, side view direction taken 90 degrees to the sectional view of FIG. 1. A flat section 40*a* at the center of the plate-like external terminal 40 is attached to the top surface of the case 2. Bent sections or legs 40*b* and 40*c* continuing to both sides of the flat section 40*a* extend along the outer surfaces of side walls 2C and 2D to the bottom of the insulating case 2 so as to provide connection ends 13 and 14 which are approximately flush with the rear surface 2*b* of the insulating case 2. Formed at the portion of the flat section 40*a* which corresponds to the inlet 7 of the insulating case 2 is a through-hole 15 for introducing the central contact of the mating coaxial connector. The through-hole 15 has the same diameter as the inlet 7 and it is formed concentrically with the inlet 7.

As described above, since the connection ends 11, 12 of the fixed terminal 4 and the movable terminal 5, and the connection ends 13, 14 of the external terminal 40 are approximately flush with the rear surface of the insulating case 2, the coaxial receptacle 1 can be easily surface-mounted. Moreover, since the flat section 40*a* is attached to the top surface of the coaxial receptacle, making the top surface flat, and the whole coaxial receptacle 1 is shaped approximately like a hexahedron, the coaxial receptacle 1 permits easier suction by a chip placer, making itself ideally suited for automated mounting owing to the easy-to-handle characteristics thereof.

Figure 11:
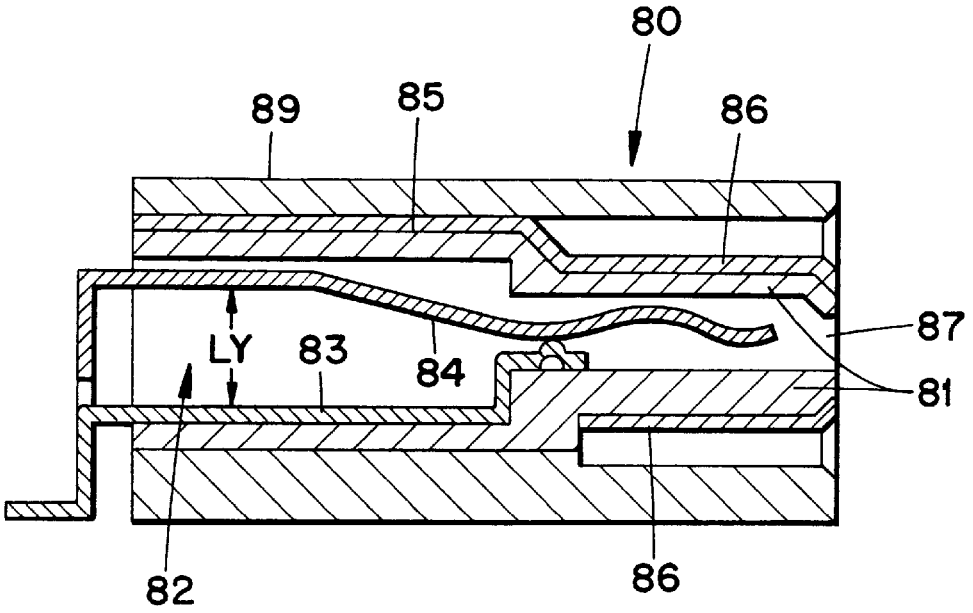
Fig. 11 (PRIOR ART)
FIG. 11 is a sectional view illustrating a conventional coaxial connector with no mating coaxial connector attached thereto.
Figure 12:
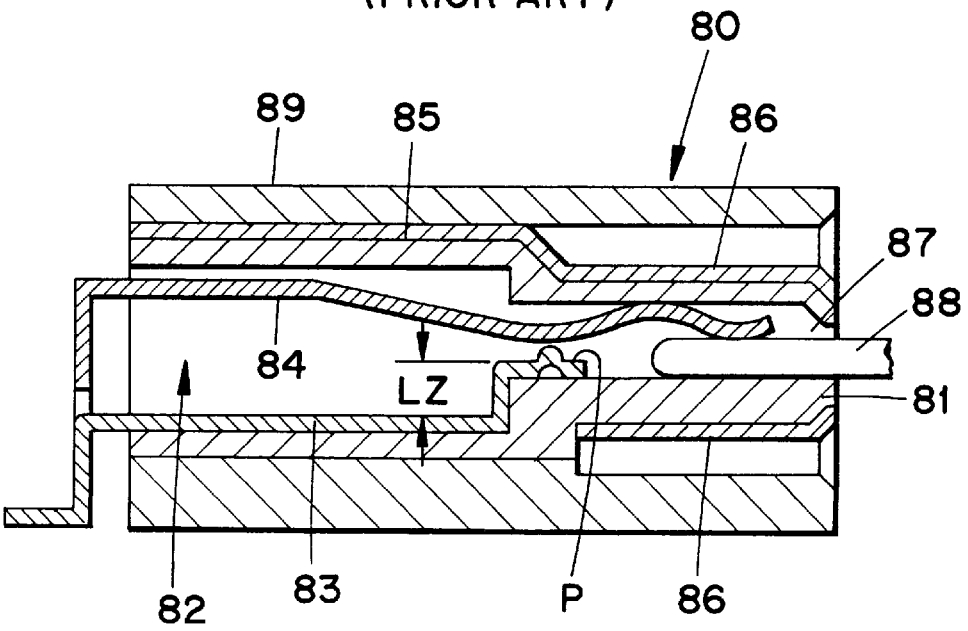
Fig. 12 (PRIOR ART)
FIG. 12 is a sectional view illustrating the conventional coaxial connector with a mating coaxial connector attached thereto.

Incidentally, automatically mounting the conventional coaxial connector 80 shown in FIG. 11 would require the additional component 89 to make the coaxial connector flat and square, resulting in an increase in the thickness an size and also higher cost.

In the coaxial receptacle 1, the external terminal 40 and the insulating case 2 are made integral, so that the insulating case 2 is fabricated while the insulating case 2 and the external terminal 40 are assembled at the same time. For example, the external terminal 40, which has been separately fabricated, is set in a mold for manufacturing the insulating case 2, and then resin is injected to fabricate the insulating case 2 to easily make the external terminal 40 and the insulating case 2 integral. This process makes the external terminal 40 an integral part of the insulating case 2, which allows the assembling accuracy to be improved and also allows the manufacturing cost to be reduced.

The method for attaching the fixed terminal 4, the movable terminal 5, and the rubber elastic member 51 to the insulating case 2 to which the external terminal 40 has been attached will now be described in detail.

The fixed terminal 4 and the movable terminal 5 fabricated by stamping beforehand, and the columnar rubber elastic member 51 which has been formed to have the sectional shape approximately identical to the bottom surface 2*a* of the insulating case 2 are prepared. First, as shown in FIG. 6A, the rubber elastic member 51 is disposed on the bottom surface 2*a* of the cavity 3 of the insulating case 2, and the movable terminal 5 is inserted in the cavity 3 through the slot 9 so that it is positioned on the elastic member 51. Then, as illustrated in FIG. 6B, with the top surface of the movable terminal 5 pushed downward, the fixed terminal 4 is pushed into the cavity 3 through the slot 8 so that the distal end thereof is positioned on the top surface of the movable terminal 5. At this time, the rubber elastic member 51 is compressed by being pushed by the movable terminal 5. After that, the force pushing the movable terminal 5 downward is removed, so that the flexibility or the restoring force of the movable terminal 5 and the elastic force or the restoring force of the compressed rubber elastic member 51 cause the movable terminal 5 to come in contact with the bottom surface of the fixed terminal 4.

In the example described above, the description has been given to the case where the slot 9 in which the movable terminal 5 is inserted and the slot 8 in which the fixed terminal 4 is inserted are located at about the same height. Even if, however, the slot in which the movable terminal is inserted is located below the slot in which the fixed terminal is inserted, the movable terminal can still be brought in contact with the bottom surface of the fixed terminal in the same manner as the foregoing example by using a flexible movable terminal which originally has an upward shape.

After installing the fixed terminal 4 and the movable terminal 5 in the insulating case 2 as mentioned above, the connection with a hoop carrier (which carries multiple coaxial receptacles 1 during the assembly process) is cut to complete the installation of the fixed terminal 4, the movable terminal 5, and the rubber elastic member 51. The result is the coaxial receptacle 1 as shown in FIG. 2. This coaxial receptacle 1 is about 3.5 mm in length and width and about 2 mm in thickness or height in the exemplary embodiment; however, the present invention is not limited thereto.

The operation of the foregoing coaxial receptacle 1 will now be described with reference to FIG. 7 and FIG. 8.

Figure 7B:
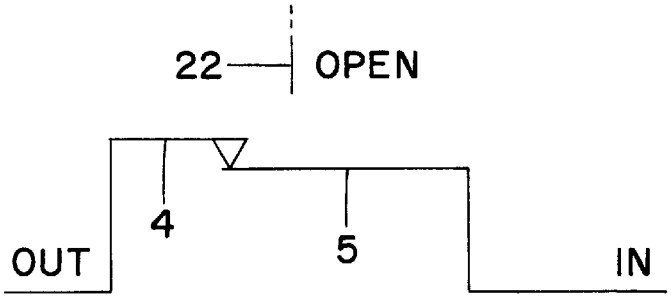

As shown in FIG. 7A, when a coaxial plug 21, which is the mating coaxial connector, is not attached, the movable terminal 5 is brought in contact with the fixed terminal 4 by the spring force thereof and the elastic force of the rubber elastic member 51, so that the fixed terminal 4 and the movable terminal 5 are electrically connected. As a result, as illustrated in FIG. 7B, an input IN of the movable terminal 5 is sent out as an output OUT from the fixed terminal 4. A central contact 22 of the coaxial plug 21 is of course open.

Conversely, as illustrated in FIG. 8A, when the coaxial plug 21, which is the mating coaxial connector, is attached, the central contact 22 introduced through the upper inlet 7 and the through-hole 15 pushes the movable terminal 5 down. This separates the movable terminal 5 away from the fixed terminal 4 to break the electrical connection between the fixed terminal 4 and the movable terminal 5, while it brings the central contact 22 into contact with the movable terminal 5. As a result, as illustrated in FIG. 8B, input IN of the movable terminal 5 is sent out as output OUT from the central contact 22. This opens the fixed terminal 4. At the same time, an outer conductor 23 of the coaxial plug 21 comes in contact with the outer terminal 40 of the coaxial receptacle 1 to establish electrical connection between the outer conductor 23 and the external terminal 40. In other words, the rubber elastic member 51 is formed to have dimensions and a material that allow more deformation under compression than that shown in FIG. 7A.

In the foregoing embodiment, the description has been given to the case where the insulating case 2 has an approximately hexahedron external shape and the columnar cavity 3. The insulating case 2 and the cavity, however, may have different shapes such as polygonal prism shapes other than columnar or square prism shapes. Likewise, the shape of the rubber elastic member is not limited to the columnar shape.

In the foregoing embodiment, the description has been given to the example where the rubber elastic member 51 made of resin such as elastomer is used as the elastic member for pressurizing the movable terminal 5 from the bottom; the elastic member, however, is not limited thereto. As the elastic member, a metallic coil spring 52 shown in FIG. 9 or a metallic leaf spring formed by bending a metal sheet may be used instead.

In the coaxial receptacle 1 shown in FIG. 9, the metallic coil spring 52 is compressed to a certain extent under the pressure applied by the movable terminal and it is located between the bottom surface 2*a* in the cavity 3 of the insulating case 2 and the movable terminal 5. In this case, the bottom surface 2*a* has a columnar hole 2*c* which has approximately the same dimension as the outside diameter of the coil spring 52; the coil spring 52 is positioned in the hole 2*c*.

The shape of the coil spring 52 is not limited to the one illustrated in FIG. 9; a helical coil spring 52 as shown in FIG. 10 may be used instead. Using the helical coil spring 52 shown in FIG. 10 makes it possible to reduce the thickness or height of the spring in its compressed state when the mating coaxial connector is attached, thus permitting the thickness or height of the coaxial receptacle 1 to be further reduced.

In the configuration described above, since the elastic force of the elastic member 51 or 52 is applied in addition to the spring force of the movable terminal 5, the force of the contact between the movable terminal 5 and the fixed terminal 4 is improved, allowing the contact resistance to be further reduced. Furthermore, since the movable terminal 5 comes in contact with the fixed terminal 4 without depending solely on the spring force thereof, the movable terminal 5 can be made shorter, so that the coaxial receptacle can be accordingly made even smaller. In other words, even when the movable terminal 5 is made shorter, it can be brought in contact with the fixed terminal 4 in a secure, stable manner by the elastic force of the elastic member 51 or 52. The force of the contact between the movable terminal 5 and the fixed terminal 4 can be set to a desired value by selecting appropriate material, shape, etc. for the elastic member 51 or 52.

In the embodiments above, the description has been given to the cases where the external terminal 40 is made integral with the insulating case 2. It is obvious, however, that the coaxial connector in accordance with the present invention can also be accomplished by separately fabricating the insulating case 2 and the external terminal 40, then by assembling them afterward.

A non-surface-mounting configuration wherein the connection ends of the fixed terminal 4 and the movable terminal 5 and/or the connection ends of the external terminal 40 project out rather than being flush with the rear surface of the insulating case 2 is another embodiment of the present invention.

In other aspects than those described above, the present invention should not be limited to the foregoing embodiments; it is apparent that working modes different in a wide range can be formed on the basis of this invention without departing from the spirit and scope of the invention.

Unlike the case of the conventional coaxial connector wherein the movable terminal and the fixed terminal are disposed horizontally in relation to the central contact of the mating coaxial connector, the coaxial connectors in accordance with the present invention have the movable terminal and the fixed terminal arranged approximately at right angles to the central contact of the mating coaxial connector. According to the invention, the distal end of the central contact of the mating coaxial connector pushes the movable terminal into the farthest end of the cavity of the insulating case to set the movable terminal and the fixed terminal apart. This configuration allows an adequate space to be secured between the movable terminal and the fixed terminal while they are set apart from each other, thus permitting the coaxial connector to be made considerably smaller.

The movable terminal is brought and held in contact with the fixed terminal by the elastic force of the elastic member, which is composed of rubber or a coil spring and which is located under the movable terminal, in addition to the spring force of the movable terminal itself. This enables an improved force of the contact between the fixed terminal and the movable terminal, permitting further reliable and stable connection therebetween. Moreover, the movable terminal can be made shorter to achieve even smaller size of the coaxial connector.

The lead sections of the movable terminal and the fixed terminal and both bent sections of the external terminal are extended to the bottom side of the insulating case to provide the connections which are approximately flush with the rear surface of the insulating case, thus accomplishing the surface-mountable coaxial connector.

Shaping the insulating case into an approximately hexahedron and attaching the flat section of the external terminal to the top surface of the case enables easy mounting by automatic mounting equipment, namely, a chip placer.

It should be noted that in the illustrated embodiments, the coaxial connector 1 is designed for product testing. The mating connector 21 is connected temporarily to the coaxial receptacle 1, and keep in contact with the coaxial receptacle for the duration of a test by hand or machine. By simple modification, however, a means for providing a more permanent connection could be added using any suitable mechanism for locking or retaining the mating connector 21 and the coaxial receptacle 1 together.

Although particular embodiments of the present invention have been shown and described, various modifications and changes will occur to those skilled in the art without departing from the spirit and scope of the present invention.

What is claimed is:

1. A coaxial connector comprising:

an insulating case having a cavity for accommodating at least a central contact of a mating coaxial connector;

an internal terminal, in the cavity of the insulating case, including a fixed terminal and a movable terminal positioned to be connected to and disconnected from each other, a portion of at least the movable terminal projecting approximately at a right angle to an axis of the central contact of the mating connector accommodated in the cavity;

an elastic member located between a bottom surface in the cavity of the insulating case and the movable terminal such that the elastic member is compressed under pressure applied by the movable terminal when the central contact of the mating connector is accommodated in the cavity of the insulating case; and an external terminal on an outer surface of the insulating case and which comes in contact with an outer conductor of the mating connector when the mating connector is attached to the insulating case;

wherein the movable terminal of the internal terminal is urged in a direction opposite to the introducing direction of the central contact by at least an elastic force of the elastic member such that the fixed terminal comes in contact with the movable terminal and both terminals come into conduction when the central contact of the mating connector is not accommodated in the cavity of the insulating case, and wherein the central contact introduced in the cavity pushes the movable terminal down toward a bottom surface of the cavity to cause the movable terminal to be detached from the fixed terminal when the central contact of the mating connector is accommodated in the cavity of the insulating case.

2. A coaxial connector according to claim 1, wherein the projecting portion of at least the movable terminal and a projecting portion of the fixed terminal of the internal terminal are spaced by a predetermined distance from the bottom surface in the cavity such that the projecting portions are approximately opposed to each other.

3. A coaxial connector according to claim 1, wherein the insulating case has an approximately hexahedron shape.

4. A coaxial connector according to claim 2, wherein the insulating case has an approximately hexahedron shape.

5. A coaxial connector according to claim 1, wherein lead sections of the movable terminal and the fixed terminal extend to a rear of the insulating case to provide connection ends nearly flush with the rear surface of the insulating case.

6. A coaxial connector according to claim 2, wherein lead sections of the movable terminal and the fixed terminal extend to a rear of the insulating case to provide connection ends nearly flush with the rear surface of the insulating case.

7. A coaxial connector according to claim 1, wherein the external terminal is a plate-like member which is attached to the insulating case and which has an approximately U-shaped longitudinal cross-section comprising a central flat section and two bent sections, a through-hole for receiving a mating coaxial connector into the cavity of the insulating case at the central flat section which covers the top surface of the insulating case, and the bent sections on both sides of the flat section extending to the rear of the insulating case along the outer surface of the side walls of the insulating case to provide connection ends nearly flush with the rear surface of the insulating case.

8. A coaxial connector according to claim 2, wherein the external terminal is a plate-like member which is attached to the insulating case and which has an approximately U-shaped longitudinal cross-section comprising a central flat section and two bent sections, a through-hole for receiving a mating coaxial connector into the cavity of the insulating case at the central flat section which covers the top surface of the insulating case, and the bent sections on both sides of the flat section extending to the rear of the insulating case along the outer surface of the side walls of the insulating case to provide connection ends nearly flush with the rear surface of the insulating case.

9. A coaxial connector according to claim 1, wherein the insulating case is integral with the external terminal.

10. A coaxial connector according to claim 2, wherein the insulating case is integral with the external terminal.

11. A coaxial connector according to claim 3, wherein the insulating case is integral with the external terminal.

12. A coaxial connector according to claim 5, wherein the insulating case is integral with the external terminal.

13. A coaxial connector according to claim 7, wherein the insulating case is integral with the external terminal.

14. A coaxial connector according to claim 1, wherein the elastic member is a rubber elastic member.

15. A coaxial connector according to claim 1, wherein the elastic member is a spring.

16. A coaxial connector according to claim 1, wherein the elastic member is a helical coil spring.

* * * * *